US006916977B2

(12) United States Patent
Hagiwara

(10) Patent No.: US 6,916,977 B2
(45) Date of Patent: Jul. 12, 2005

(54) DRUM

(75) Inventor: Takashi Hagiwara, Hamamatsu (JP)

(73) Assignee: Yamaha Corporation, Shizuoka (JP)

( * ) Notice: Subject to any disclaimer, the term of this patent is extended or adjusted under 35 U.S.C. 154(b) by 87 days.

(21) Appl. No.: 10/458,980

(22) Filed: Jun. 10, 2003

(65) Prior Publication Data

US 2004/0016336 A1 Jan. 29, 2004

(30) Foreign Application Priority Data

Jun. 10, 2002 (JP) ..... 2002-168656

(51) Int. Cl.[7] ..... G10F 1/12

(52) U.S. Cl. ..... 84/411 R; 84/413; 84/415; 84/411 A

(58) Field of Search ..... 84/411 R, 413, 84/415, 411 A

(56) References Cited

U.S. PATENT DOCUMENTS 4,385,544 A * 5/1983 Heiskell ..... 84/422.4

* cited by examiner

*Primary Examiner*—Shih-Yung Hsieh
(74) *Attorney, Agent, or Firm*—Koda & Androlia

(57) ABSTRACT

In a drum in which a drum head installed on one or both of open ends of a trunk main body that constitutes a drum main body of the drum is tightened by lug bolts and stretched by a hoop, reinforcing rings are provided in anchoring holes that are formed in the hoop for receiving bolt heads of the lug bolts.

7 Claims, 2 Drawing Sheets

DRUM

BACKGROUND OF THE INVENTION

1. Field of the Invention

The present invention relates to a drum which is constructed as a percussion instrument and more particularly to a drum that has a wooden hoop that stretches the drumhead.

2. Prior Art

FIG. 3 shows a basic configuration of a conventional drum which is constructed as percussion instruments.

In this drum, a trunk main body 1 formed in a cylindrical shape from plywood, synthetic resin fibers, a light metal, etc. is used as the main body of the drum; and a drum head 2 made of natural leather, a synthetic resin film, etc. is disposed on one or both open ends of this trunk main body 1. In addition, a hoop(s) 3 which surrounds the outer circumference of the drumhead 2 is disposed on the drumhead 2. A plurality of lugs 4 (which are the head stretching and securing fixtures) are disposed on the outside surface of the trunk main body 1. The lug bolts 5 of the lugs 4 are tightened so that the drum head(s) 2 is stretched by the hoop(s) 3 with a uniform force.

In this drum, the drumhead 2 is typically struck with a tip end of a stick, and occasionally a "rim shot" is made in which the hoop 3 is struck with a middle portion of such a stick. When performing the rim shot, various types of playing are possible. In one playing method, a sharp high note is generated by striking only the hoop; and in another type of play, the hoop and the drum head are struck simultaneously.

In cases where the rim shot is played in a drum that uses a wooden hoop, a distinctive tone color that is not seen in the case of a metal hoop is obtained. On the other hand, however, there are problems in terms of durability. In other words, in the case of a wooden hoop, anchoring holes for the bolt heads of the lug bolts used to stretch the drum head(s) are formed in the hoop, and thus these areas of the hoop are thin in thickness. Consequently, when these portions are repeatedly struck by a stick, cracks referred to by the reference symbol G are generated as seen in FIG. 4, causing various damages.

SUMMARY OF THE INVENTION

Accordingly, the present invention is to solve the problems encountered in conventional drums that use a wooden hoop.

The object of the present invention is to improve the durability of the wooden hoop so that cracks and damage can be avoided in the areas of the anchoring holes for the bolt heads of the lug bolts even if these areas are struck in the rim shot play.

The above object is accomplished by a unique structure for a drum in which the drum head that is installed on one or both open ends of a trunk main body, which is a drum main body, is tightened by lug bolts and stretched by a hoop; and in the present invention, reinforcing rings are installed in anchoring holes that are formed in the hoop for receiving the bolt heads of the lug bolts, thus reinforcing the hoop.

DETAILED DESCRIPTION OF THE INVENTION

Figure 1:
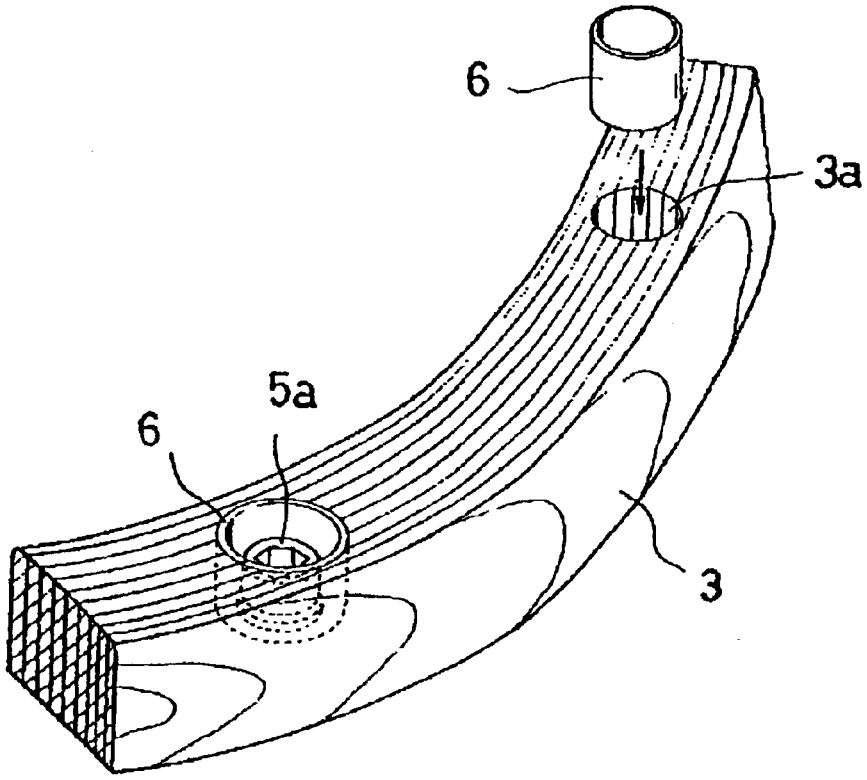
FIG. 1 illustrates a part of the hoop according to the present invention.
Figure 2:
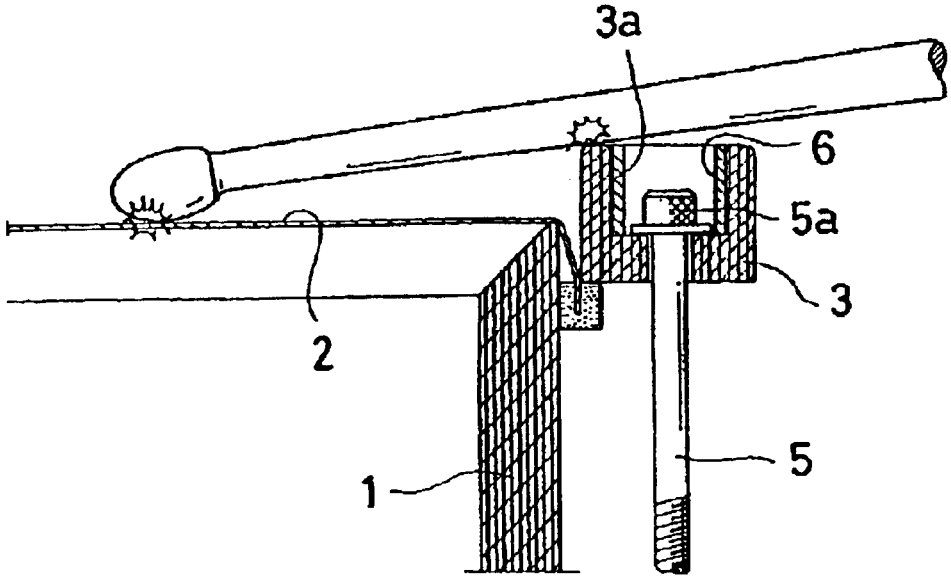
FIG. 2 shows in cross-section the hoop of the present invention installed on a drum.
Figure 3:
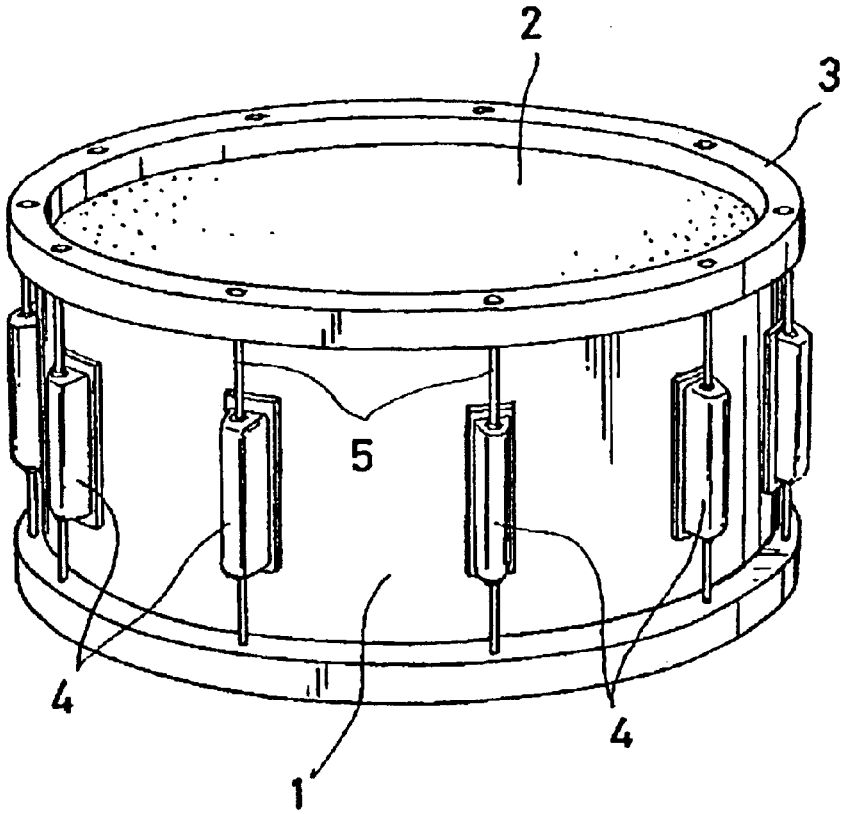
FIG. 3 PRIOR ART
FIG. 3 is a perspective view of a common drum.
Figure 4:
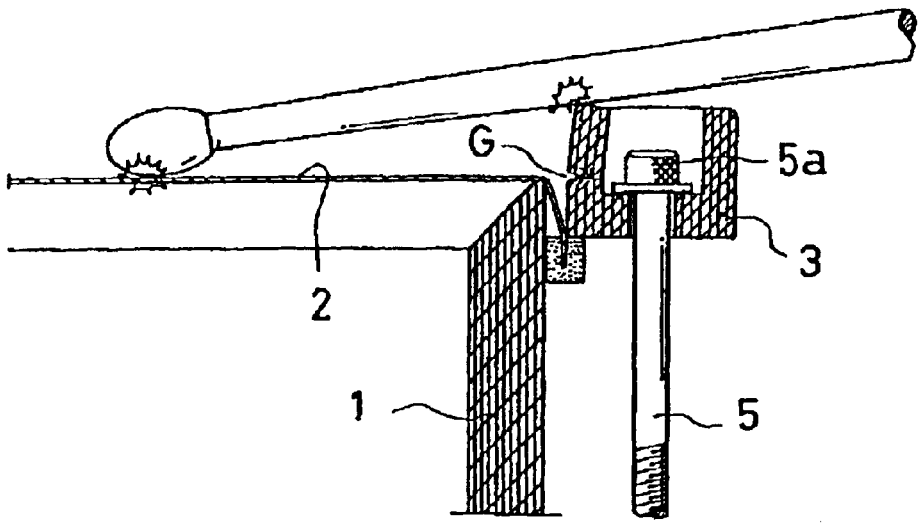
FIG. 4 PRIOR ART
FIG. 4 shows in cross section the problems with a conventional drum.

Preferred embodiments of the present invention, which is shown in FIGS. 1 and 2, will be described in detail below. Elements that are the same as in the conventional drum are labeled with the same reference numerals, and a description of such elements is omitted.

FIG. 1 shows the hoop of the present invention. The hoop 3 of a circular shape has a laminated structure formed by wooden elements. A plurality of anchoring holes 3*a* for the bolt heads 5*a* of lug bolts 5 are formed in this hoop 3 in a plurality of specified positions so that axis of each one of the anchoring holes 3*a* is parallel to the axis of the circular hoop 3. Furthermore, reinforcing rings 6 made of a metal or synthetic resin are fastened by, for instance, press-fitting in these anchoring holes 3*a*.

FIG. 2 shows hoop 3 in the completed state. As seen from FIG. 2, each of the reinforcing rings 6 is completely embedded in each of the anchoring holes 3*a* of the hoop 3, and thus the rings 6 are made integral unit with the anchoring holes 3*a* of the hoop 3. As a result, hoop 3 has an increased rigidity in the areas of the anchoring holes 3*a*; and even if these areas are struck with a stick as shown in FIG. 2, there is no cracking or damage occur unlike the conventional drums, since the durability of the hoop 3 is improved.

Fastening of the reinforcing rings 6 can be accomplished by applying an adhesive agent when the reinforcing rings 6 are fitted in the manufacturing process of the hoop 3. Moreover, the fastening of the reinforcing rings 6 to the anchoring holes 3*a* by fitting can be performed selectively in accordance with the areas where the rim shot play is performed.

As seen from the above, in the present invention, the anchoring holes in a wooden hoop for the bolt heads of the lug bolts are securely reinforces by the reinforcing rings 6; and thus, no cracks or damage would occur in the hoop even if the hoop or the areas where the anchoring holes are formed are subjected to a strong hitting by the rim shot play. Accordingly, a drummer is not subjected to any psychological effect regarding damage to the drum, etc.; and damage to the external appearance of the drum over time can be avoided.

What is claimed is:

1. A drum in which a drum head which is installed on at least of open ends of a trunk main body that constitutes a drum main body of said drum is tightened by means of at least one lug bolt and stretched by means of a hoop, wherein said hoop is of a circular shape and comprises a laminated structure formed from a plurality of wooden elements and reinforcing rings are provided in anchoring holes that are formed in said hoop for receiving a bolt head of said lug bolt.

2. The drum according to claim 1, wherein said reinforcing rings are press fitted into said anchoring holes.

3. The drum according to claim 1, wherein an outer surface of said reinforcing ring is bonded to an inner surface of said anchoring holes by an adhesive.

4. The drum according to claim 2, wherein said reinforcing rings are made from metal.

5. The drum according to claim 2, wherein said reinforcing rings are made from synthetic resin.

6. The drum according to claim 3, wherein said reinforcing rings are made from metal.

7. The drum according to claim 3, wherein the reinforcing rings are made from synthetic resin.

* * * * *